US006308613B1

(12) United States Patent
Takahashi

(10) Patent No.: US 6,308,613 B1
(45) Date of Patent: Oct. 30, 2001

(54) FLUID PRESSURE CYLINDER HAVING LOCK MECHANISM

(75) Inventor: Hidehito Takahashi, Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/499,395

(22) Filed: Feb. 7, 2000

(30) Foreign Application Priority Data

Feb. 25, 1999 (JP) ..... 11-048498

(51) Int. Cl.[7] ..... F15B 15/26
(52) U.S. Cl. ..... 92/18
(58) Field of Search ..... 92/17, 18, 19, 92/23, 24, 25

(56) References Cited

U.S. PATENT DOCUMENTS

| | | | | |
|---|---|---|---|---|
| 2,759,569 | * | 8/1956 | Keehn | 188/355 |
| 4,015,698 | * | 4/1977 | Sousamian et al. | 188/265 |
| 4,214,795 | * | 7/1980 | Kakuminato | 92/25 X |
| 4,700,814 | * | 10/1987 | Mitchell | 92/25 X |
| 5,553,690 | | 9/1996 | Takahashi | 118/300 |
| 5,823,300 | * | 10/1998 | Higuchi | 92/25 X |

FOREIGN PATENT DOCUMENTS

| | | | | |
|---|---|---|---|---|
| 608704 | * | 9/1948 | (GB) | 92/25 |

* cited by examiner

*Primary Examiner*—John E. Ryznic
(74) *Attorney, Agent, or Firm*—Oblon, Spivak, McClelland, Maier & Neustadt, P.C.

(57) ABSTRACT

A fluid pressure cylinder has a lock mechanism in which its entire structure is simple. Also, its assembling operation and maintenance are easy. The lock mechanism to be assembled to a body of a cylinder includes a fulcrum pin for immovably supporting a lock plate in its axial direction. A spring biases the lock plate in its tilting direction around the fulcrum pin. A returning pressure chamber is provided on the side in which the lock plate is tilted by the biasing spring and applies a fluid pressure to the lock plate against a force of the biasing spring by supplying a pressurized fluid. A sleeve is fitted over a piston rod of the cylinder for forming an inner peripheral wall of the returning pressure chamber. A pressure receiving member for air-tightly sealing a space between the lock plate and an outer peripheral surface of the sleeve and between the lock plate and an inner peripheral surface of the returning pressure chamber is mounted to the lock plate closer to the returning pressure chamber.

4 Claims, 3 Drawing Sheets

FLUID PRESSURE CYLINDER HAVING LOCK MECHANISM

TECHNICAL FIELD

The present invention relates to a fluid pressure cylinder having a lock mechanism capable of locking a piston rod of the fluid pressurecylinder at a necessary operational position by the lock mechanism.

PRIOR ART

As a fluid pressure cylinder having a lock mechanism for locking a piston rod at an arbitrary position, one shown in FIG. 5 is known. According to this cylinder, a lock plate 52 fitted to a piston rod 51 is tilted around a fulcrum 59 by a biasing force of a spring 58, thereby locking the rod 51 in a twisting manner, and the lock plate 52 is returned to a non-tilted state by supplying compressed air to a pressure chamber of the lock mechanism, thereby releasing the lock.

In the fluid pressure cylinder having such a lock mechanism, since the compressed air pressure supplied to the pressure chamber 53 is applied to the lock plate 52 when the lock is released, it is general that a piston 54 is juxtaposed with the lock plate 52, and pressure receiving members 56 and 57 are mounted between the piston 54 and an outer peripheral surface of a sleeve 55 forming an inner peripheral wall of the pressure chamber 53 as well as between the piston 54 and an outer peripheral wall of the pressure chamber 53, respectively.

However, in this kind of conventional fluid pressure cylinder, since the piston 54 is juxtaposed with the lock plate 52, the entire structure is complicated. Further, since it is necessary to mount the two pressure receiving members 56 and 57 to the piston 54, the number of parts is prone to be increased, and it needs to entail much labor for assembling the lock mechanism itself in some cases. Further, it is necessary to remove the piston 54 whenever the pressure receiving members 56 and 57 which are consumable items are exchanged, and maintenance and the like are troublesome in many cases.

Further, when the lock mechanism is assembled to a body 50 of the fluid pressure cylinder, since the compressed air is not supplied to the pressure chamber 53, the lock plate 52 and the piston 54 are prone to be tilted. Therefore, the lock 51 is locked by the lock plate 52 and thus, it is difficult to fit the rod 51 to the lock plate 52, and the mounting operation is not easy.

DISCLOSURE OF THE INVENTION

A technical object of the present invention is to provide a fluid pressure cylinder having a lock mechanism in which its entire structure is simple, and its assembling, maintenance and the like are easy.

Another technical object of the invention is to provide a fluid pressure cylinder having a lock mechanism in which the lock mechanism can easily be mounted to the fluid pressure cylinder.

To achieve the above object, according to a fluid pressure cylinder of the present invention, a lock mechanism for locking a piston rod in a predetermined operation position comprises an annular lock plate for locking the piston rod, a fulcrum pin for tiltably supporting the lock plate, biasing means for tilting the piston rod in its locking direction around the fulcrum pin, and returning means for returning the tilted lock plate in a lock-releasing direction. The returning means comprises a pressure chamber for introducing a pressurized fluid and a pressure receiving member comprising a single annular member which is operated by the fluid pressure for returning the lock plate. In a state where the seal of the inner peripheral end is abutted against an outer peripheral surface of the sleeve which fluid-tightly guides the piston rod and the seal of the outer peripheral end is abutted against an inner peripheral surface of the pressure chamber, the pressure receiving member is disposed such as to partition one side of the pressure chamber at a position adjacent the lock plate and is mounted to an end surface of the lock plate.

According to the fluid pressure cylinder of the present invention having the above structure, the piston rod is locked and the lock is released by supplying and discharging the pressurized fluid to and from the pressure chamber of the lock mechanism. In a state where the pressurized fluid is discharged from the pressure chamber, the lock plate is tilted around the fulcrum pin by a biasing force of the biasing means for locking the piston rod in a twisting manner. In a state where the pressurized fluid supplied to the pressure chamber, the fluid pressure is applied to the side of the pressure receiving member of the lock plate, the tilt of the lock plate is returned against the biasing force by the biasing means so that the lock of the piston rod is released.

In this case, the pressure receiving member comprising the single member for sealing the space between the lock plate and the outer peripheral surface and between the lock plate and the inner peripheral surface of the pressure chamber is mounted to the pressure chamber of the lock plate in the lock mechanism so that the fluid pressure supplied to the pressure chamber is directly applied to the lock plate. Therefore, unlike the prior art, it is unnecessary to juxtapose the piston, a plurality of pressure receiving member to be mounted to the piston are unnecessary and thus, the entire lock mechanism has an extremely simple structure and the number of parts is small,and assembling operation thereof is very easy. Further, since the pressure receiving member which is a consumable item is the single member, the exchanging operation and maintenance are easy as compared with the prior art.

In the present invention, pressure chamber which is directly applied to the lock plate and the pressure receiving members can be provided with a recess and a projection which are mutually fitted and locked, and the pressure receiving member can be connected to the lock plate by fitting the recess and projection to each other. With this structure, the pressure receiving member can be mounted and exchanged very easily.

In the invention, a body of the lock mechanism can be formed with a pin hole through which a pin for temporarily holding the lock plate in the lock-releasing position is inserted.

In this case, when the lock mechanism is mounted to the body of the fluid pressure cylinder, if the pin is inserted into the pin hole, since the lock plate can be temporarily held in the non-tilted state, the piston rod is not locked by the lock plate, and it can easily be inserted into and pulled out from the lock plate, and the mounting operation can be carried out easily.

DETAILED EXPLANATION

Figure 1:
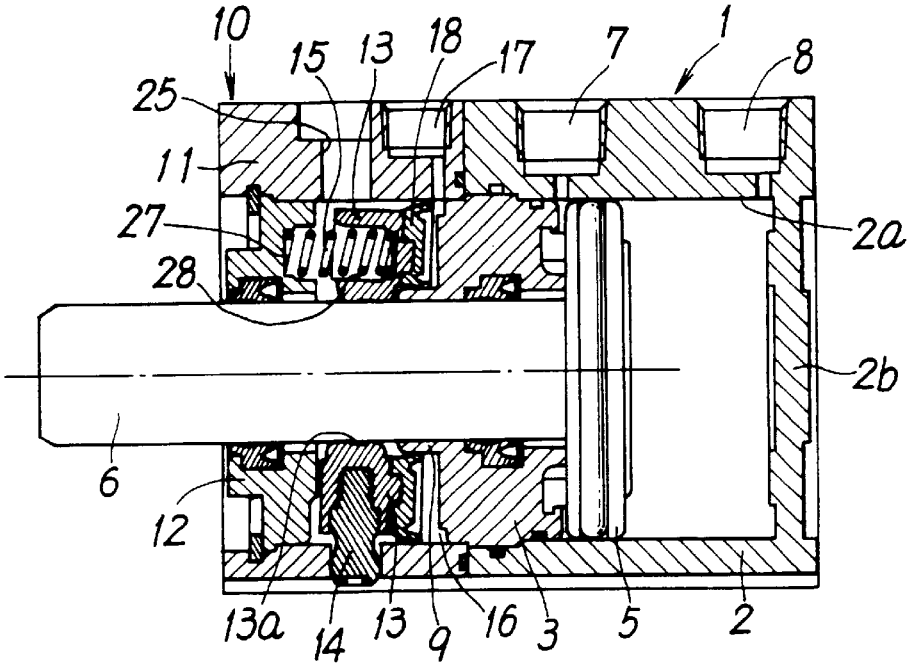
FIG. 1 is a sectional view (a portion thereof is a sectional view taken along the line I—I in FIG. 2) showing one embodiment of the present invention.

FIG. 1 shows one embodiment of a fluid pressure cylinder having a lock mechanism of the present invention. This fluid pressure cylinder 1 includes a cylinder body 2 having a cylinder bore 2*a* and one end of the cylinder body 2 being closed with a head cover 2*b*, a rod cover 3 mounted to the other end of the body 2, a piston 5 slidably fitted in the cylinder bore 2*a*, and a piston rod 6 integrally formed with the piston 5 and extending outside through the rod cover 3. A pressurized fluid is supplied to and discharged from pressure chambers provided at opposite sides of the piston 5 through cylinder ports 7 and 8 respectively formed on the side of the rod cover 3 on the body 2 and on the side of the head cover 2*b*, thereby driving the piston 5 and the piston rod 6.

A lock mechanism 10 is mounted to the cylinder 1 closer to the rode cover 3 for locking the piston rod 6 extending from the rod cover 3.

This lock mechanism 10 includes a cylindrical lock mechanism body 11, and an end cover 12 mounted to one end side of the lock mechanism body 11. The other end side of the lock mechanism body 11 is mounted such as to be contacted with the rod cover 3, and the piston rod 6 of the cylinder 1 is extended outside through the center of the end cover 12, thereby integrally forming the lock mechanism body 11 with the cylinder 1.

Figure 2:
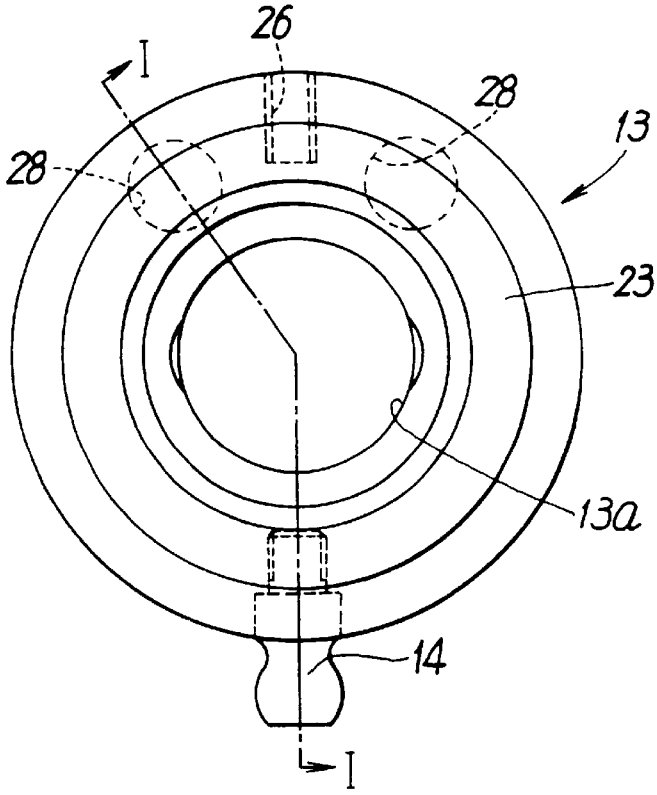
FIG. 2 is an enlarged front view of a lock plate.

The end cover 12, the lock plate 13 and the like in FIG. 1 are shown in cross section taken along the line I—I in FIG. 2.

The lock mechanism 10 is provided in the lock mechanism body 11 with an annular lock plate 13 tiltably fitted to the piston rod 6, a fulcrum pin 14 for supporting the lock plate 13 at one point of the outer periphery such that the lock plate 13 is tiltable but axially immovable, and two resilient biasing means 15 and 15 for biasing the lock plate 13 in a tilting direction around the fulcrum pin 14. The lock mechanism 10 further includes a returning pressure chamber 16 provided in the lock plate 13 closer to the rod cover 3, a port 17 formed in the lock mechanism body 11 for supplying and discharging pressurized fluid to and from the returning pressure chamber 16, and a pressure receiving member 18 which is mounted to a side of the lock plate 13, and which is operated to return the lock plate 13 in a lock-releasing direction against the biasing force of the biasing means 15 and 15 when the pressurized fluid is supplied to the returning pressure chamber 16.

In this lock mechanism 10, if the lock plate 13 is tilted toward the piston 5 around the fulcrum pin 14 by the biasing means 15 and 15, the lock plate 13 is locked in a state where the lock plate 13 twists the cylinder rod 6. If the pressurized fluid is supplied to the pressure chamber 16 from the port 17, the tilted lock plate 13 is returned to a position substantially at right angles with respect to an axis of the cylinder rod 6 so that the lock is released. Further, in the lock mechanism 10, if a force in a direction for retreating the rod 6 into the cylinder 1 is applied to the rod 6 when the cylinder rod 6 is locked by the lock plate 13, since the tilting angle of the lock plate 13 is increased, a braking force is increased so that rod does not move. However, if a force in the advancing direction is applied to the rod 6, the lock plate 13 is moved in the lock-releasing direction against the biasing force of the biasing means 15 and 15 by a friction force generated between the rod 6 and the lock plate 13 and therefore, the braking force is reduced and the cylinder rod 6 can be moved. Thus, in an emergency for example, if only the compressed air in the pressure chamber of the cylinder 1 is discharged, it is possible to move the cylinder rod 6 in a direction projecting from the cylinder 1. Therefore, to ensure safety with this, it is appropriate to utilize the fluid pressure cylinder having the lock mechanism.

As shown in FIG. 2, the lock plate 13 is provided at its central portion with an insertion hole 13*a* through which the piston rod 6 is inserted. The piston rod 6 is locked by bringing an inner peripheral edge of the insertion hole 13*a* into contact with the piston rod 6 under pressure.

A diameter of the insertion hole 13*a* is slightly greater than that of the piston rod 6 to an extend that the insertion hole 13*a* does not come into contact with the piston rod 6 in the non-tilted state of the lock plate 13.

The fulcrum pin 14 is inserted from outside of the lock mechanism body 11, a screw portion formed on a tip end of the fulcrum pin 14 is threaded to a portion of the outer periphery of the lock plate 13, and the lock plate 13 is mounted to the lock mechanism body 11 such that the lock plate can tilt in the axial direction of the piston rod 6 by the fulcrum pin 14. In this case, it is preferable that the mounting position of the fulcrum pin 14 to the lock mechanism body 11 is a position where the non-tilted state is established when the lock plate 13 comes into contact with the end cover 12.

The biasing means 15 and 15 are disposed at two close locations between the end cover 12 and the lock plate 13 at the opposite side from the fulcrum pin 14 with respect to the piston rod 6.

In this embodiment, each of the biasing means 15 and 15 is entirely formed of expandable spring. The spring is fixed in stationary holes 27 and 28 formed between the end cover 12 and the lock plate 13 at two locations such as to be opposed to each other so that the spring does not hinder the lock plate 13 when the tilted lock plate 13 is returned.

The returning pressure chamber 16 is formed by a space surrounded by an inner peripheral wall of the lock mechanism body 11, the rod cover 3 for air-tightly guiding the piston rod 6, an outer peripheral surface of a sleeve extending from the rod cover 3, and the pressure receiving member 18 mounted to the lock plate 13.

Figure 3:
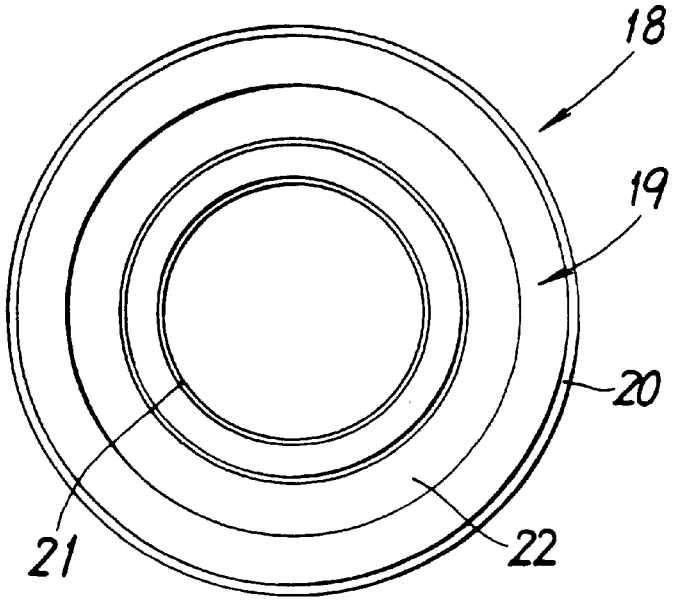
FIG. 3 is an enlarged front view of a pressure receiving member as viewed from a mounting surface thereof with respect to the lock plate.

As shown in FIG. 3, the pressure receiving member 18 partitioning one end side of the returning pressure chamber 16 comprises an annular single member. The pressure receiving member 18 includes a base 19 for mounting the pressure receiving member 18 to an end surface of the lock plate 13, and lip seals 20 and 21 respectively formed on an outer peripheral end and an inner peripheral end for sealing spaces between the lock plate 13 and an outer peripheral surface of the sleeve 9 and between the lock plate 13 and an inner peripheral surface of the returning pressure chamber 16, i.e., an inner peripheral wall of the lock mechanism body 11.

Each of the seals 20 and 21 projects from an end surface of the lock plate 13 toward the pressure chamber. The seal 20 on the outer peripheral end is in contact with the inner peripheral wall of the lock mechanism body 11, and the seal 21 on the inner peripheral end is in contact with the outer peripheral surface of the sleeve 9.

The pressure receiving member 18 is mounted to the lock plate 13 in such a manner that a projection and a recess are provided between the pressure receiving member 18 closer to the mounting surface of the base 19 and the lock plate 13 closer to the end surface, and both the projection and recess are fitted.

In the present embodiment, there are provided a recess 22 formed annularly on the side of the pressure receiving member 18, and a projection 23 provided on the side of the lock plate 13 and having a shape corresponding to that of the recess 22. The recess may be provided on the side of the lock plate 13, and the projection may be provided on the side of the pressure receiving member 18.

A pin hole 25 is formed in the lock mechanism body 11 so that a pin 24 for temporarily holding the lock plate 13 at a lock-releasing position can be inserted in the pin hole 25.

Figure 4:
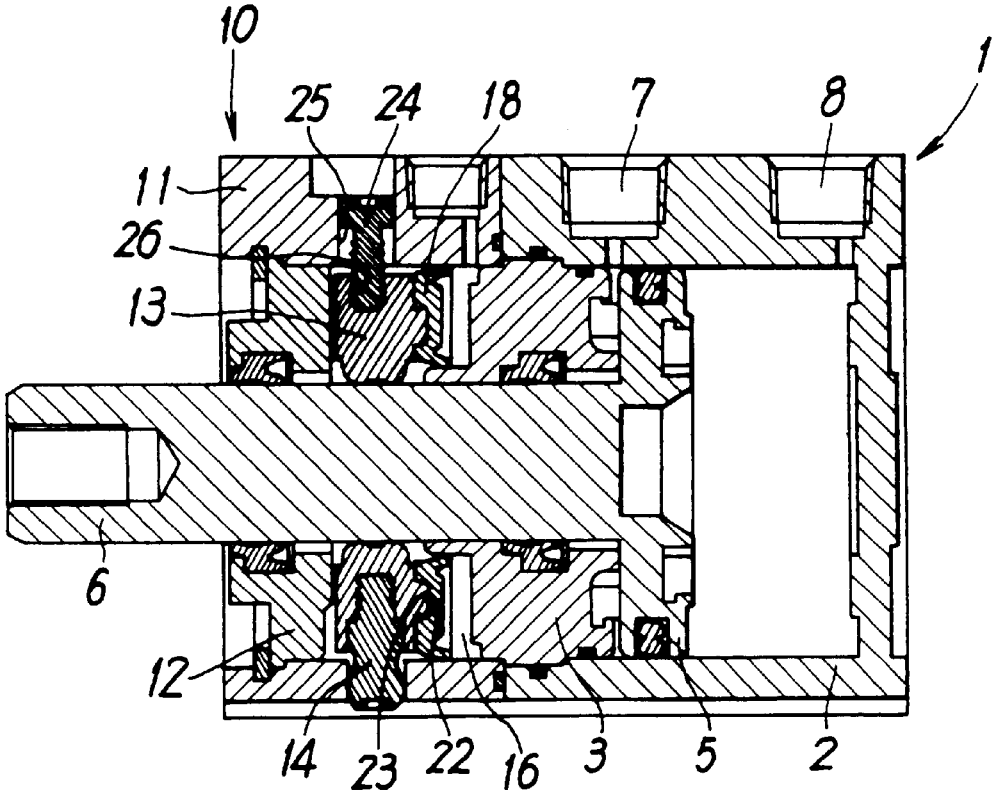
FIG. 4 is a sectional view showing the lock plate which is held in its non-tilted state by a pin.
Figure 5:
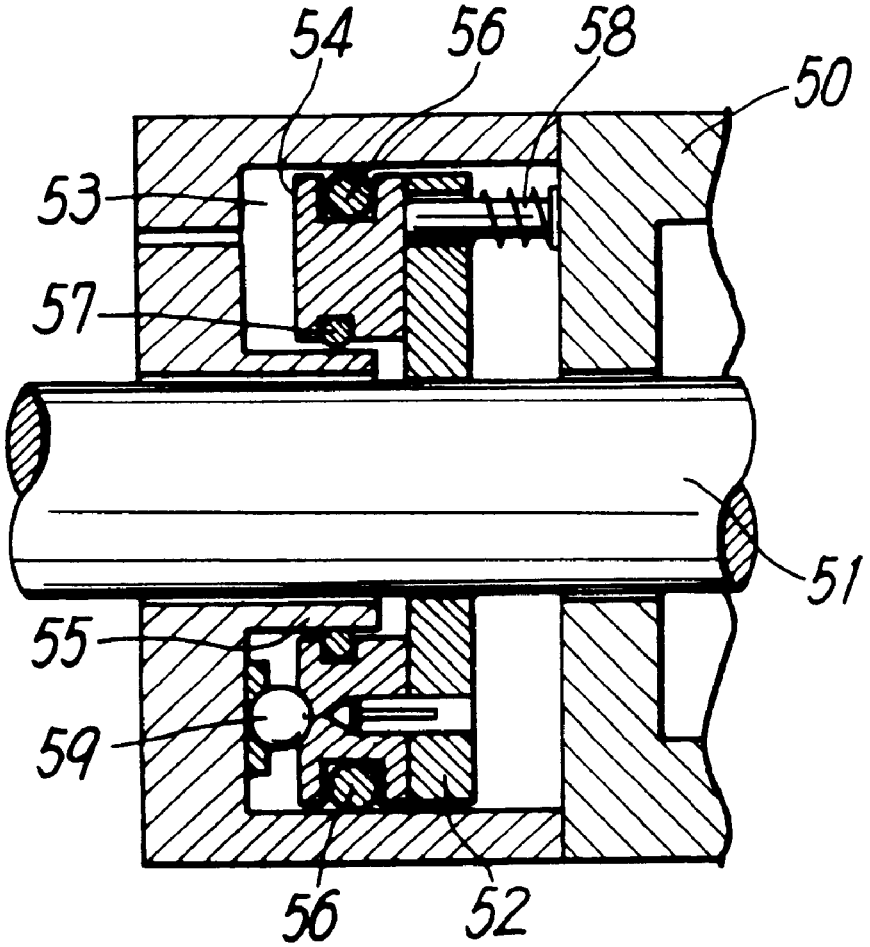
FIG. 5 PRIOR ART
FIG. 5 is a sectional view of a conventional fluid pressure cylinder having a lock mechanism.

As shown in FIG. 4, the pin 24 and the pin hole 25 are for holding the lock plate 13 which receives not fluid pressure in the non-tilted state when the lock mechanism 10 is attached to and detached from the cylinder 1, so that piston rod 6 can be inserted to and detached from the insertion hole 13*a* without being locked.

The pin hole 25 is formed in a position exactly opposite from the mounting position of the fulcrum pin 14 in the lock mechanism body 11.

The pin 24 is formed into a flat head screw form, and its screw portion can be threaded into an engagement hole 26 formed in a position corresponding to the pin hole 25 in the outer peripheral portion of the lock plate 13, and the screw head is immovably held in the pin hole 25 when the pin 24 is inserted into the pin hole 25.

It is not always necessary to form the pin 24 into the screw shape.

As shown in FIG. 2, positional relation between the engagement hole 26 in the lock plate 13 and the stationary holes 28 and 28 of the biasing means 15 and 15 is set such the positions of the stationary holes 28 and 28 are slightly deviated from each other in the circumferential direction so that they do not interfere with each other.

According to the fluid pressurecylinder having the lock mechanism of the above structure, the piston rod 6 is locked and the lock is released by supplying and discharging the pressurized fluid to and from the returning pressure chamber 16 of the lock mechanism 10. That is, if the pressurized fluid is discharged from the returning pressure chamber 16, the lock plate 13 tilts around the fulcrum pin 14 by the biasing means 15 to lock the piston rod 6 such as to twist the latter. On the contrary, if the pressurized fluid is supplied to the returning pressure chamber 16, the fluid pressure is applied to the lock plate 13 through the pressure receiving member, the lock plate 13 is returned from the tilted state against the biasing force of the biasing means 15 and therefore, the lock of the piston rod 6 is released.

In this case, in the lock mechanism 10, the pressure receiving member 18 comprising the single member for sealing between the lock plate 13 and the outer peripheral surface of the sleeve 9 and the inner peripheral surface of the returning pressure chamber 16 is mounted to the lock plate 13 closer to the returning pressure chamber 16, and the fluid pressure supplied to the returning pressure chamber is directly applied to the lock plate 13. Therefore, unlike the prior art, it is unnecessary to juxtapose a piston for receiving the pressure, and a plurality of pressure receiving member to be mounted to the piston are unnecessary and thus, the entire lock mechanism 10 has an extremely simple structure and the number of parts is small, and assembling operation thereof is very easy.

Further, since the pressure receiving member 18 is the single member, the exchanging operation and maintenance are easy as compared with the prior art.

Furthermore, the pressure receiving member 18 can extremely easily and reliably be mounted to the lock plate 13 by providing the mutually fitted recess 22 and projection 23 between the pressure receiving member 18 and the lock plate 13 and therefore, the maintenance can be carried out more easily.

At the time of assembling or maintenance, when the lock mechanism 10 is assembled to the cylinder 1 and removed therefrom, the pin 24 is inserted to the pin hole 25 from outside of the lock mechanism body, the pin 24 is threadedly inserted into the engagement hole 26 of the lock plate 13, and the lock plate 13 is temporarily held in the non-tilted state.

In this case, since the piston rod 6 is not locked by the lock plate 13, even when the piston rod 6 is inserted through the lock mechanism 10 and extended outside or when the piston rod 6 is removed out from the lock mechanism, such operation can easily be carried out, and mounting and removing operations of the lock mechanism 10 can be done extremely smoothly.

Although the lock plate 13 is mounted to the pressure receiving member 18 using the recess 22 and the projection 23 provided between the lock plate 13 and the pressure receiving member 18 in the above embodiment, such a structure is not always necessary, and the lock plate 13 may be mounted by arbitrary structure.

Further, according to the lock mechanism 10 in the above embodiment, when the cylinder rod 6 is locked, a strong braking force is applied to the rod 6 in the direction retreating the rod 6 into the cylinder 1 and a large braking force is not applied to the rod 6 in the direction in which the rod 6 projects from the cylinder 1. However, the present invention should not be limited to this structure. For example, the sleeve 9 may be extended from the end cover 12, the pressure receiving member 18 may be mounted to the end cover 12 of the lock plate 13, the positional relationship between the returning pressure chamber 16 and the biasing means 15 with respect to the lock plate 13 may be inverted so that when the rod 6 is locked, a braking force is not applied to the rod 6 in the direction in which the rod 6 retreats into the cylinder 1 and a strong braking force is applied to the rod 6 in the direction in which the rod 6 projects from the cylinder 1.

As described above in detail, according to the fluid pressure cylinder having the lock mechanism, the pressure receiving member comprising the single member for sealing the space between the lock plate and the outer peripheral surface and between the lock plate and the inner peripheral surface of the pressure chamber is mounted to the pressure chamber of the lock plate in the lock mechanism so that the fluid pressure supplied to the pressure chamber is directly applied to the lock plate. Therefore, unlike the prior art, it is unnecessary to juxtapose the piston, a plurality of pressure receiving member to be mounted to the piston are unnecessary and thus, the entire lock mechanism has an extremely simple structure and the number of parts is small, and assembling operation thereof is very easy.

Further, since the pressure receiving member is the single member, the exchanging operation and maintenance are easy as compared with the prior art.

Furthermore, when the lock mechanism is mounted to the body of the fluid pressurecylinder, if the pin is inserted into the pin hole, the lock plate can temporarily be held in the non-tilted state. Therefore, the piston rod should not be locked by the lock plate, it can easily be inserted into and pulled out from the lock plate, and the mounting operation can be carried out easily.

What is claimed is:

1. A fluid pressure cylinder comprising:

a cylinder body, a piston provided in said cylinder body and operated by a fluid pressure applied to said piston, a piston rod provided in said cylinder body and extended from said piston, and a lock mechanism provided in said cylinder body and configured to lock said piston rod in a predetermined operation position, wherein said lock mechanism includes an annular lock plate tiltably fitted to said piston rod for locking said piston rod by tilting movement, a fulcrum pin configured to support said lock plate tiltably on said cylinder body around one point of an outer periphery of said fulcrum pin, a biasing device configured to tilt said piston rod in its locking direction around said fulcrum pin, and a returning device configured to return said tilted lock plate in a lock-releasing direction by the fluid pressure applied thereto, wherein said returning device includes a pressure chamber configured to introduce a pressurized fluid and also includes a pressure receiving member having a single annular member operated by the fluid pressure introduced into said pressure chamber for returning said lock plate in said lock-releasing direction, and wherein said pressure receiving member is provided at an inner peripheral end and an outer peripheral end each respectively with a lip seal, and in a state where said lip seal of said inner peripheral end is abutted against an outer peripheral surface of a sleeve which fluid-tightly guides said piston rod and said lip seal of said outer peripheral end is abutted against an inner peripheral surface of said pressure chamber, said pressure receiving member is disposed so as to partition one side of said pressure chamber at a position adjacent said lock plate and is connected to an end surface of said lock plate.

2. A fluid pressure cylinder according to claim 1, wherein said lock plate and said pressure receiving member are provided with a recess and a projection which are mutually fitted and locked, and wherein said pressure receiving member is connected t o said lock plate by fitting said recess and said projection to each other.

3. A fluid pressure cylinder comprising:

a cylinder body, a piston which is provided in said cylinder body and operated by a fluid pressure applied to said piston, a piston rod which is provided in said cylinder body and extended from said piston, and a lock mechanism which is provided in said cylinder body for locking said piston rod in a predetermined operation position, wherein said lock mechanism comprises an annular lock plate tiltably fitted to sa id piston rod for locking said piston rod by tilting movement, a fulcrum pin for tiltably supporting said lock plate on said cylinder body around one point of an outer periphery of said fulcrum pin, biasing means for tilting said piston rod in its locking direction around said fulcrum pin, and returning means for returning said tilted lock plate in a lock-releasing direction by the fluid pressure applied thereto, said returning means comprises a pressure chamber for introducing a pressurized fluid, a pressure receiving member comprising a single annular member which is operated by the fluid pressure introduced into said pressure chamber for returning said lock plate in said lock-releasing direction, and said pressure receiving member is provided at its inner peripheral end and outer peripheral end with seal portions, and in a state where said seal portion of said inner peripheral end is abutted against an outer peripheral surface of a sleeve which fluid-tightly guides said piston rod and said seal portion of said outer peripheral end is abutted against an inner peripheral surface of said pressure chamber, said pressure receiving member is disposed such as to partition one side of said pressure chamber at a position adjacent said lock plate and is connected to an end surface of said lock plate, wherein said cylinder body and lock plate are provided with holes through which a pin for temporarily holding said lock plate in said lock-releasing position is inserted.

4. A fluid pressure cylinder comprising:

a cylinder body, a piston which is provided in said cylinder body and operated by a fluid pressure applied to said piston, a piston rod which is provided in said cylinder body and extended from said piston, and a lock mechanism which is provided in said cylinder body for locking said piston rod in a predetermined operation position, wherein said lock mechanism comprises an annular lock plate tiltably fitted to said piston rod for locking said piston rod by tilting movement, a fulcrum pin for tiltably supporting said lock plate on said cylinder body around one point of an outer periphery of said fulcrum pin, biasing means for tilting said piston rod in its locking direction around said fulcrum pin, and returning means for returning said tilted lock plate in a lock-releasing direction by the fluid pressure applied thereto, said returning means comprises a pressure chamber for introducing a pressurized fluid, a pressure receiving member comprising a single annular member which is operated by the fluid pressure introduced into said pressure chamber for returning said lock plate in said lock-releasing direction, and said pressure receiving member is provided at its inner peripheral end and outer peripheral end with seal portions, and in a state where said seal portion of said inner peripheral end is abutted against an outer peripheral surface of a sleeve which fluid-tightly guides said piston rod and said seal portion of said outer peripheral end is abutted against an inner peripheral surface of said pressure chamber, said pressure receiving member is disposed such as to partition one side of said pressure chamber at a position adjacent said lock plate and is connected to an end surface of said lock plate, wherein said biasing means comprises a plurality of coil springs, said coil springs are disposed adjacent to each other substantially in opposite position from said fulcrum pin of said lock plate with respect to said piston rod.

* * * * *